US005107670A

United States Patent [19]

Hauers et al.

[11] Patent Number: 5,107,670

[45] Date of Patent: Apr. 28, 1992

[54] SPINNING APPARATUS SERVICE CARRIAGE WITH PNEUMATIC WASTE COLLECTION AND DISPOSAL

[75] Inventors: Manfred Hauers, Viersen; Dieter Vits, Neuss; Wolfgang Igel, Ebersbach/Fils, all of Fed. Rep. of Germany

[73] Assignees: Zinser Textilmaschinen GmbH, Ebersbach/Fils; Ernst Jacobi, Gersthofen; Sohler Airtex GmbH, Wangen, all of Fed. Rep. of Germany

[21] Appl. No.: 642,322

[22] Filed: Jan. 16, 1991

[30] Foreign Application Priority Data

Jan. 16, 1990 [DE] Fed. Rep. of Germany ..... 4001007

[51] Int. Cl.[5] ..... D01H 11/00; A47L 5/38

[52] U.S. Cl. ..... 57/304; 15/312; 134/18

[58] Field of Search ..... 57/300, 301, 304, 305, 57/306, 268; 15/301, 312.1

[56] References Cited

U.S. PATENT DOCUMENTS

| | | | |
|---|---|---|---|
| 2,799,356 | 7/1957 | Hewitt | 57/304 X |
| 3,115,000 | 12/1963 | Naegli | 57/304 |
| 3,908,346 | 9/1975 | Lee, Jr. | 57/304 X |
| 4,333,772 | 6/1982 | Mulligan et al. | 15/312.1 X |
| 4,485,616 | 12/1984 | Morita et al. | 57/304 X |
| 4,835,957 | 6/1989 | Stahlecker et al. | 57/304 X |

FOREIGN PATENT DOCUMENTS

| | | |
|---|---|---|
| 0165908 | 12/1985 | European Pat. Off. . |
| 1454586 | 1/1969 | Fed. Rep. of Germany . |
| 1454589 | 8/1970 | Fed. Rep. of Germany . |
| 1510721 | 4/1971 | Fed. Rep. of Germany . |
| 3047945 | 7/1982 | Fed. Rep. of Germany . |
| 3340672 | 6/1985 | Fed. Rep. of Germany . |
| 3400841 | 7/1985 | Fed. Rep. of Germany . |
| 3733550 | 4/1989 | Fed. Rep. of Germany . |
| 1052831 | 2/1989 | Japan . |
| 601520 | 7/1978 | Switzerland . |
| 381622 | 8/1932 | United Kingdom . |

*Primary Examiner*—Daniel P. Stodola
*Assistant Examiner*—John F. Rollins
*Attorney, Agent, or Firm*—Herbert Dubno

[57] ABSTRACT

A ring-spinning apparatus has a service carriage which can be positioned opposite a stationary waste-collection receptacle so that the mobile waste-collection receptacle of the carriage can be aligned therewith and shifted toward the stationary waste-collection receptable thereby coupling the doors of the receptacle. An actuator can simultaneously open the coupled doors to permit a pressure drop to draw lint and roving scraps collected in the receptacle of the carriage into the receptacle of the machine.

10 Claims, 2 Drawing Sheets

SPINNING APPARATUS SERVICE CARRIAGE WITH PNEUMATIC WASTE COLLECTION AND DISPOSAL

FIELD OF THE INVENTION

Our present invention relates to a ring-spinning apparatus of the type in which an elongated spinning machine has a multiplicity of spinning stations along one or each side of the machine and serviceable by a service carriage which is movable along the spinning machine and can be provided with service facilities, for example, means for replacing bobbins at the stations with which the carriage is juxtaposed. More particularly, the invention relates to improvements in the handling of dust, lint, roving scraps and the like which may be picked up by the suction system of the service carriage and particularly a waste-collection receptacle on the service carriage.

BACKGROUND OF THE INVENTION

A ring-spinning apparatus for the spinning of roving or the like into yarn generally comprises a ring-spinning machine having a multiplicity of spinning stations along each side of the machine, each station having a spindle for receiving a bobbin upon which a yarn can be received The rovings can be fed from the respective roving bobbins or spools through drafting rollers and each spinning station can be further provided with a traveller about which the strand is looped.

For bobbin replacement, i.e. for the replacement of an empty bobbin core by a full roving bobbin or spool, a service carriage can be provided which can be automated so that, when it is lined up or juxtaposed with a respective station, bobbin replacement can be effected, e.g. automatically, and the spinning operation can be continued.

Generally speaking such a machine will also comprise a suction device which can draw dust, lint and yarn, thread and roving scraps from the active part of the spinning stations to a waste-collection receptacle which can be located, for example, at an end of the machine. The suction means can include a filter belt which can be displaced past the stations, means for drawing the lint and roving scraps against this belt and to means for sucking the waste from the belt to the waste-collection receptacle. Alternatively, suction heads can be spaced along the machine at the various stations to pick up the lint and roving scraps.

It is also known to provide the service cart as or with a cleaning unit, i.e. a suction source for drawing the lint and roving scraps generated upon spool replacement into a waste-collection receptacle on the service carriage. The service carriage can be provided with other servicing facilities as well, for example, thread or yarn inserters, thread-tying mechanisms, or thread positioners, or the like for facilitating restoration of operation of a particular station or correction of a yarn or thread break at such a station.

The carriage can be displaceable upon a guide rail above the ring-spinning machine or set into or onto the floor of the mill laterally of the spinning machine and extending therealong.

In German open application DE-OS 30 47 945, a travelling cleaning unit can be provided above the spinning machine and has a filter box for collecting the lint, dust or roving scraps which are picked up by suction.

The filter box is generally emptied at the waste-disposal station at the end of the machine into an easily replaceable dust-collection sack in which a slight subatmospheric pressure is generated by connection to the suction unit intrinsic to the spinning machine.

In German open application DE-OS 15 10 721, the spinning machine is provided with a traveling-cleaning unit having an L-shaped cross section. A vertical blowpipe has a multiplicity of blowing nozzles. In the horizontal machine housing there is provided an upwardly directed suction opening which is covered by a filter element. The filter element is connected to a cleaning device disposed at the end of the spinning machine and communicating with the central suction unit of the ring-spinning machine which removes lint and the like from the filter element. The suction opening of this cleaning unit is generally closed off and is open only upon the arrival of the travelling-cleaning unit.

German patent document DE-PS 14 54 589 describes a travelling-cleaning unit for a textile machine which has a blower arrangement, suction and blowing pipes and a filter box for collecting the dust or lint which has been sucked up. The suction or blast flow of this unit can be deflected via a plurality of flaps which can blow clear and clean the filter when the travelling-cleaning unit is in a waste-disposal station at the end of the machine.

German open application DE-37 33 550 discloses a travelling cleaner of the aforedescribed general type whose filter chamber can be closed by a pneumatically actuatable flat slider. By means of an opening cylinder, this flat slider can be actuated together with a slider for the waste-disposal unit to connect the filter chamber of the travelling-cleaning unit to the waste-disposal unit.

German open document DE-OS 14 54 586 describes a travelling cleaner whose filter chamber empties into a separate waste-disposal unit nearby the spinning machine The emptying is effected either by blowing out the filter chamber by a blower located in the travelling-cleaning unit or by sucking off the residue collected in the filter unit. For this purpose the waste-disposal unit can be equipped with a suction blower.

In German patent document DE 34 00 841, the fibrous lint which is not picked up by the suction unit built into the textile machine and developing during operation thereof is removed by a cleaning unit which is displaceable along a support and guide rail arranged on the floor of the factory and extending in a U shape around the spinning machine. The cleaning unit travels in a path determined by the cleaning cycle first along one longitudinal side of the machine, then around an end thereof and along the opposite side of the machine.

The cleaning unit of the textile machine draws the lint-laden air through suction elements into a filter chamber. The lint is separated by a filter in the filter chamber from the air. To empty the filter chamber, the emptying opening is provided and a blast of air is generated through the filter in counterflow to the flow which drew the lint onto the filter. The collected lint is blown off the filter and the counterflowing air cleans the latter.

To generate this reverse flow of air, a complex flap and slider system is required. To empty the filter chamber, a first flap is opened to connect the suction side of the blower with the ambient air so that ambient air is drawn into the system.

The suction line running to the filter chamber is closed by a further flap which interrupts the suction of air from the filter chamber. A third slider opens a connection between the pressure side of the blower and the filter chamber. This type of slider and flap in mutual operation and the systems utilizing same are expensive to construct, maintain and operate.

As a consequence, there have previously been efforts to simplify such systems.

In German open application DE 33 40 672, a cleaning device is described which has a shiftable waste-collection receptacle which, by its shifting, is selectively connectable to the suction or pressure side of a blower. The extended waste-collection receptacle, connected to the suction side of the blower, can then be emptied via a bottom flap.

The Swiss patent 601 520 describes a service carriage for a spinning machine which has, apart from the thread-break monitoring and retying devices, also a cleaning unit. This cleaning unit has suction and blowing nozzles and collects the lint in a filter chamber mounted on the service carriage This filter chamber is equipped at its front side with an emptying flap.

It should also be noted that at a station at the end of the ring-spinning machine, the spinning machine can be provided with a special lint-collection device which has a suction nozzle on each side of the machine and which, upon the approach of the service carriage, presses the emptying flaps inwardly. The filter chamber of the service carriage can thus be cleaned out by means of a strong suction blower.

The drawback of this system is the disposition of the lint-collection device in the region of the service carriage path. Furthermore this device requires an additional lint-collection unit since the suction unit of the spinning machine itself is not positioned or constructed or arranged to clean the filter chamber of the service carriage.

OBJECTS OF THE INVENTION

It is, therefore, the principal object of the present invention to provide a ring-spinning apparatus which can have at least one service carriage and wherein this service carriage has a waste-collection receptacle so that this receptacle can be automatically emptied without obstructing the path of the service carriage.

Another object of the invention is to provide an improved ring-spinning apparatus whereby drawbacks of earlier systems are avoided.

Still another object of this invention is to provide an economical and efficient cleaning system for a ring-spinning apparatus which affords maximum versatility with respect to the operation of the system.

SUMMARY OF THE INVENTION

These objects and others which will become apparent hereinafter are attained, in accordance with this invention, in a ring-spinning apparatus which comprises:

an elongated ring-spinning machine having a multiplicity of spinning stations spaced apart along at least one longitudinal side of the machine;

a waste-collection station forming part of and disposed along the side of the machine and provided with:

- a stationary waste-collection receptacle,
- means for applying suction to the station whereby lint and roving scraps are collected from the machine in the receptacle, and
- a normally closed door openable by movement in a given direction to afford access to the stationary waste-collection receptacle;

a service carriage displaceable along the side of the machine and including:

- a mobile waste-collection receptacle for collecting lint and roving scraps on the carriage,
- means on the carriage for generating suction to draw lint and roving scraps into the mobile waste-collection receptacle, and
- a normally closed door openable by movement in the direction to afford access to the mobile waste-collection receptacle; and means for coupling the doors together for joint movement in the direction upon juxtaposition of the carriage with the waste-collection station for enabling suction generated at the waste-collection station to apply a pressure gradient between the mobile waste-collection receptacle and the stationary waste-collection receptacle discharging the mobile waste-collection receptacle into the stationary waste-collection receptacle.

More specifically, the invention is characterized in that the waste-collection receptacle of the service carriage which can be of automatic operation, is laterally connectable to the waste-collection receptacle of the ring-spinning machine, the receptacles are displaceable relative to one another, i.e. toward and away from one another which, when the receptacles are brought together, enables the doors or closures of the receptacle to be connected together via appropriate coupling elements, whereby an actuator, effector or driver on the carriage or on the machine can actuate these closures to permit communication between the receptacles so that a pressure differential can be created to permit waste collected in the receptacle of the service carriage to be transferred to the receptacle of the machine.

The waste-collection receptacle of the carriage provided with the roving-bobbin-change mechanism is laterally connected to the waste-collection receptacle at the end of the ring-spinning machine by enabling the waste-collection receptacles to be displaced relatively to one another and, in the position in which the waste-collection receptacles approach one another, the covers of the receptacle are interconnected so that upon joint opening of these covers, a pressure drop is created between the waste-collection receptacle to empty the receptacle of the service carriage into the receptacle of the spinning machine.

Such an arrangement eliminates the need for having in the path of the service carriage any elements extending therein and also eliminates special lint-collecting units in addition to the units associated with the service carriage on the machine itself.

According to a feature of the invention, the waste-collection receptacle of the service carriage is mounted for movement in guides of the service carriage and can be displaced by a driver, especially a piston-and-cylinder pusher, toward the waste-collection receptacle of the ring-spinning machine. The closure plate or door at the front side of the waste-collection receptacle is provided preferably as a slider which is displaceable in guides.

The slider of the waste-collection receptacle of the service carriage can be displaceable by means of a driver on the carriage, for example, a piston-and-cylinder pusher, e.g. to raise this slider to have a coupling element engageable with a complementary coupling element with the slider of the waste-collection receptacle of the ring-spinning machine to lift the latter simultaneously.

According to a further feature of the invention, for producing the pressure gradient between the waste-collection receptacles which draws the collected waste from the receptacle of the service carriage into the receptacle of the ring-spinning machines, means can be provided for cutting off the suction source of the carriage during or shortly after displacement of the carriage receptacle toward the machine receptacle. Alternatively, the blocking element can be provided in the suction pipe of the service carriage which can be operated to reduce the suction in the waste receptacle of that carriage so that the suction from the machine receptacle will prevail.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
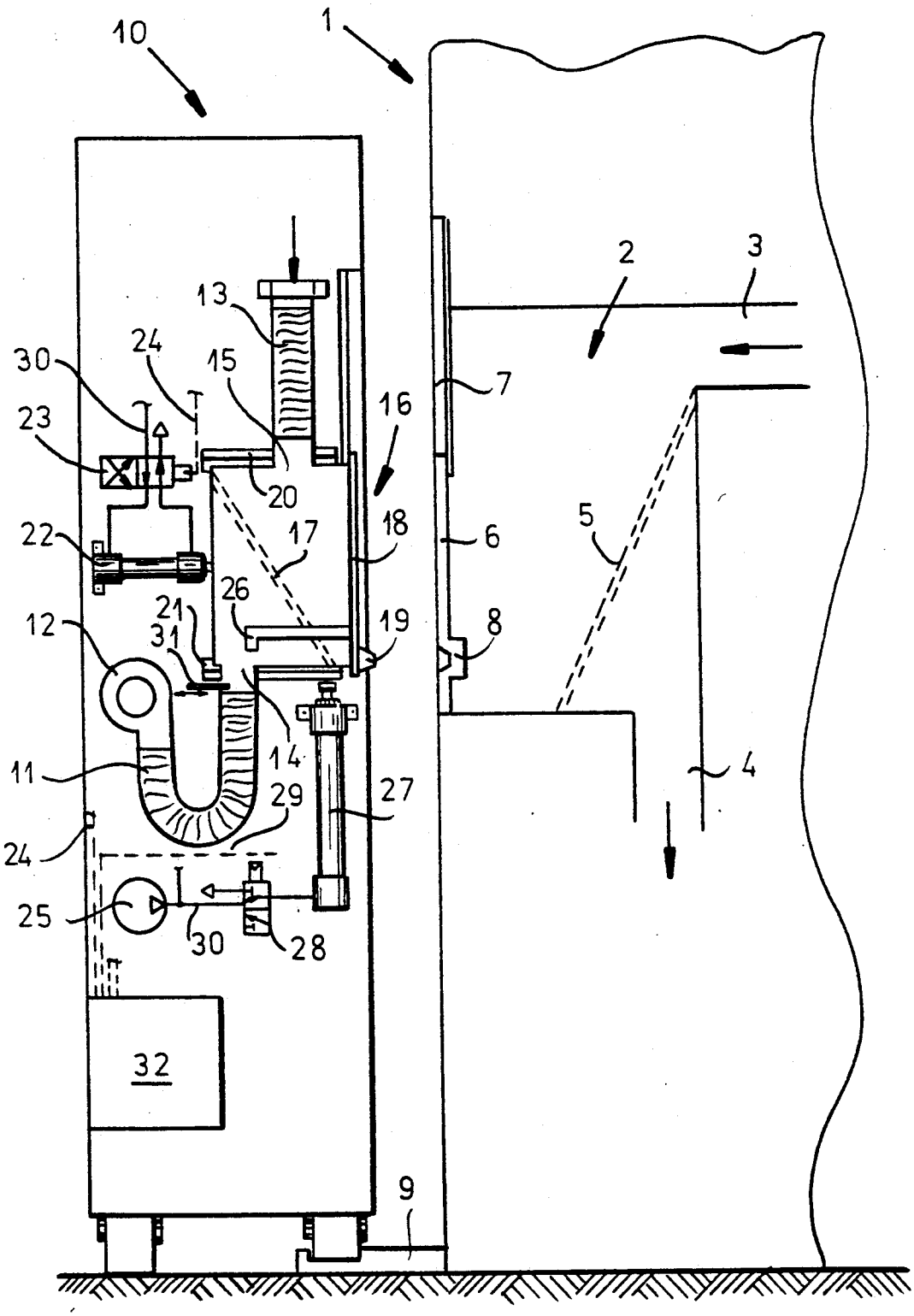
FIG. 1 is a diagrammatic side elevational view with parts in section of the end station of a ring-spinning machine showing the relationship of a service carriage therewith according to the invention.

FIG. 1 shows an end station I of a spinning machine 100 (FIG. 2) provided along each longitudinal side thereof with a multiplicity of ring-spinning stations 101 which can be serviced by service carriages 10 movable along a rail 9 on the floor of the spinning mill at least on one side of the machine The end station 1 can be provided with a suction system for drawing lint, yarn scraps, roving scraps and thread fragments into the collection station via a system represented only in dot-dash lines at 102.

Each of the service carriages 10 can be equipped with a servicing mechanism such as a bobbin-change mechanism or the like represented symbolically at 103 and utilized to replace the bobbins of the stations 101. The mechanism 103 may include thread-piecing means, roving or yarn bobbin-changing means, spinning-station cleaning means or any other servicing facility commonly provided on the service carriage.

The end station 1 is connected to a suction source represented at 104 for applying the machine suction for vacuuming up the lint and other spinning mill detritus.

Returning to FIG. 1, it can be seen that the suction source 104 can be connected via a suction line 4 to a waste-collection receptacle 2 at the end station 1 of the machine.

Figure 2:
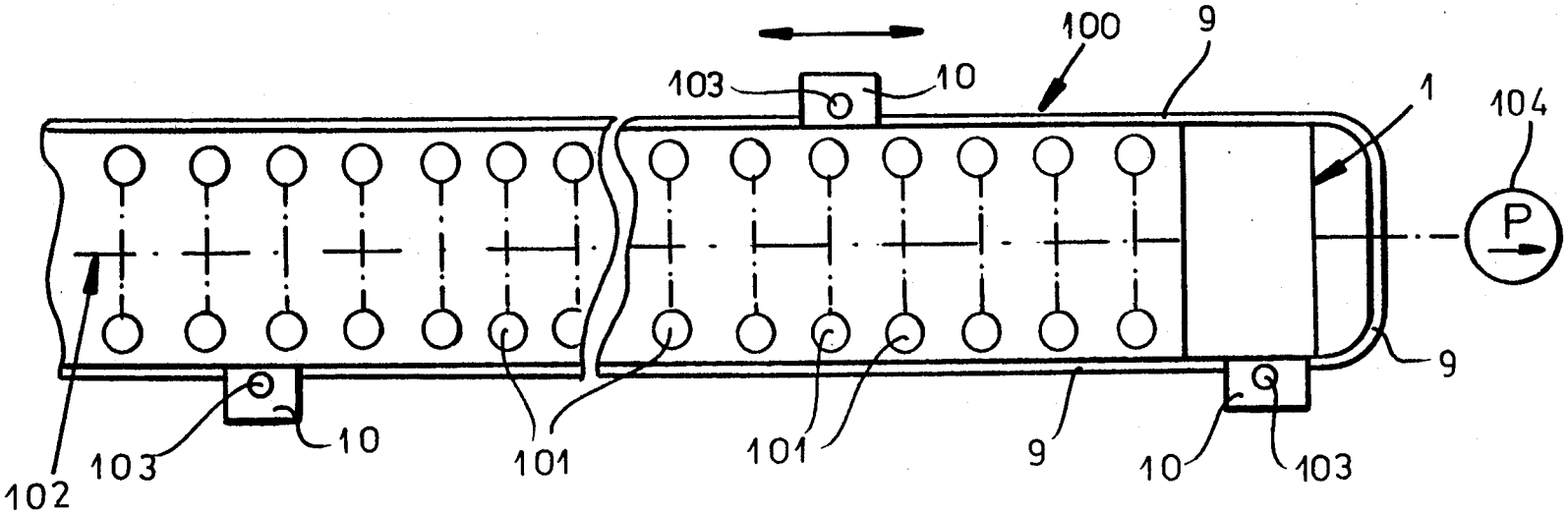
FIG. 2 is a plan view of a ring-spinning machine also showing an end station and having a plurality of service carriages associated therewith.

As is common, the waste-collection receptacle 2 can be provided with a filter 5 upon which the collected waste can accumulate and can have a suction line 3 which can be connected to the suction units at the individual spinning station, e.g. via the system represented at 102 in FIG. 2.

The front wall (FIG. 1) of the waste-collection receptacle 2 has a cover 6 which closes an access opening in this wall and is constituted as a slider guided in guide 7 of the stationary waste-collection receptacle.

Each service carriage 10, in addition to being positionable on the selected spinning stations 101 requiring servicing, can be positioned opposite the end station 1 as is shown in FIG. 1.

The bobbin-change mechanism can also remove an empty roving bobbin from which the last of the roving has been drawn and replace it with a full roving bobbin from a supply thereof. Such a mechanism is likewise represented at 103. During the bobbin-change processes and, indeed, in practically any operations effected by the service carriage at the spinning stations 101, lint or fibrous waste is generated. This can occur during the mounting of a new roving bobbin, clearing off a substantially empty bobbin sleeve or any other operations.

In order to vacuum up such wastes at the spool-changing mechanism, for example, each service carriage has its own suction source 12 which can be connected by a flexible suction line 11 to a mobile waste-collection receptacle 16. The waste-collection receptacle 16 can be connected by a flexible suction line 13 to the suction heads (not shown) of the service carriage.

The waste-collection receptacle 16 is provided with a filter 17 which subdivides the receptacle 16 into two chamber halves. In addition, the waste-collection receptacle 16 is slidable horizontally in guides 20 and 21. At its side confronting the stationary waste-collection receptacle 2, the receptacle 16 is provided with a closure door 18 which is also formed as a slider displaceable vertically in a guide on the receptacle 16, i.e. in the same manner and in alignment with the door 6.

When the roving-bobbin-change mechanism of the carriage automatically effects a roving-bobbin-change cycle, fibrous waste is collected in the receptacle 16. When the waste accumulation is sufficient or a complete pass along the machine has been effected, the carriage 10 is juxtaposed with the end station 1 of the spinning machine. The carriage 10 is halted in a position in which the sliders 6 and !8 are precisely in registry with one another, corresponding to an alignment of the openings of the receptacles 2 and 16.

In this position, a piston-and-cylinder pusher 22 displaces the receptacle 16 in the guides 20 and 21 against the slider 6. For this purpose, the piston-and-cylinder unit 22 is controlled by a valve 23 supplied by a fluid-medium line 30 connected to a fluid-pressure source 25 and via a control line 24 with the control unit 32 of the carriage.

As the receptacle 16 is extended from the carriage 10, a coupling element 19 on the slider !8 engages in a complementary coupling element 8 on the slider 6. Simultaneously or immediately thereafter, the control unit 32 establishes a pressure drop between the receptacle 16 of the carriage on the receptacle 2 of the ring-spinning machine.

This pressure drop can be generated, for example, by shut off of the suction source 12 of the carriage 10 or by complete or partial blocking of the suction line 11 via the shutter 31.

In the fully extended position of the receptacle 16, an abutment 26 of the slider 18 is exactly aligned with a piston-and-cylinder pusher 27, controlled by a valve 28 connected with the fluid pressure source 25. The valve 28 is controlled, in turn, by a control line 29 from the control unit 32. Operation of this pusher to extend the piston rod thereof lifts the abutment 26, the slider 18 and the guide and, via the coupling elements 8 and 19, also lifts the slider 6 of the waste-collection receptacle 2, thereby placing the two receptacles into communication.

The pressure drop or suction favoring the receptacle 2 which has a higher level of suction than the receptacle 16 causes the fiber waste to be sucked out of the receptacle 16 into the receptacle 2. The doors can then be closed and the receptacle 16 restricted for further use of the carriage. The receptacle 2 can be cleaned out by hand or by an automatic cleaner intrinsic to the machine.

We claim:

1. A ring-spinning apparatus comprising:

an elongated ring-spinning machine having a multiplicity of spinning stations spaced apart along at least one longitudinal side of the machine;

a waste-collection station forming part of and disposed along said side of said machine and provided with:

a stationary waste-collection receptacle, means for applying suction to said station whereby lint and roving scraps are collected from said machine in said receptacle, and a normally closed door openable by movement in a given direction to afford access to said stationary waste-collection receptacle;

a service carriage displaceable along said side of said machine and including:

automatic bobbin change means for replacing a roving bobbin at selective ones of said spinning stations upon positioning of said carriage at said spinning stations, a mobile waste-collection receptacle for collecting lint and roving scraps on said carriage, means on said carriage for generating suction to draw lint and roving scraps into said mobile waste-collection receptacle, and a normally closed door openable by movement in said direction to afford access to said mobile waste-collection receptacle; and means for coupling said service carriage door form-lockingly with mating components on said waste-collection station door together for joint movement in said direction upon juxtaposition of said carriage with said waste-collection station for enabling suction generated at said waste-collection station to apply a pressure gradient between said mobile waste-collection receptacle and said stationary waste-collection receptacle discharging said mobile waste-collection receptacle into said stationary waste-collection receptacle.

2. The apparatus defined in claim 1 wherein said mobile waste-collection receptacle of said service carriage is mounted for movement toward and away from said stationary waste-collection receptacle.

3. The apparatus defined in claim 2 wherein said carriage is provided with guides, said mobile waste-collection receptacle being mounted on said guides and being provided with a driver for shifting said receptacle.

4. The apparatus defined in claim 3 wherein said driver is a piston-and-cylinder pusher for said mobile waste-collection receptacle.

5. The apparatus defined in claim 4, further comprising a driver on said carriage for displacing said doors into open positions upon displacement of said mobile waste-collection receptacle toward said stationary waste-collection receptacle.

6. The apparatus defined in claim 5 wherein said driver for displacing said doors is a piston-and-cylinder pusher.

7. The apparatus defined in claim 6 wherein said carriage is provided with a machine-specific control unit controlling valves through respective control lines, said valves being connected to said piston-and-cylinder pushers.

8. The apparatus defined in claim 1 wherein said doors are slidable shutters movable in respective guides.

9. The apparatus defined in claim 1 wherein said means on said carriage for generating suction is a suction source having at least two selectable suction levels.

10. The apparatus defined in claim 1 wherein said means on said carriage for generating suction includes a suction pipe connected to said mobile waste-collection receptacle and an actuatable suction-blocking element between said pipe and said mobile waste-collection receptacle.

* * * * *